United States Patent [19]

Cushing

[11] Patent Number: 5,016,262

[45] Date of Patent: May 14, 1991

[54] CASH CADDY

[76] Inventor: Michelle Cushing, 9833 Daines Dr., Temple City, Calif. 91780

[21] Appl. No.: 422,100

[22] Filed: Oct. 16, 1989

[51] Int. Cl.[5] ..... G08B 13/08; G07D 13/00; G06M 1/22

[52] U.S. Cl. ..... 377/15; 206/0.81; 206/0.83; 206/459; D17/24

[58] Field of Search ..... 206/0.8, 0.81, 0.82, 206/0.83, 0.84, 459, 561, 564; 84/94.1; D17/24; 377/6, 7, 15

[56] References Cited

U.S. PATENT DOCUMENTS

| | | | |
|---|---|---|---|
| D. 171,436 | 2/1954 | Breen | D17/24 |
| 1,457,227 | 5/1923 | Price | 206/0.83 |
| 1,521,248 | 12/1924 | Mahan | 206/0.83 |
| 2,053,599 | 9/1936 | Brinkerhoff | 206/0.83 |
| 2,296,989 | 9/1942 | Forsyth | 206/0.83 |
| 2,959,274 | 11/1960 | Moss et al. | 206/0.81 |
| 4,553,252 | 11/1985 | Egendorf | 377/15 |
| 4,688,023 | 8/1987 | McGill | 206/459 |

*Primary Examiner*—John S. Heyman
*Attorney, Agent, or Firm*—James E. Brunton

[57] ABSTRACT

A portable apparatus suitable for use by a waitress for carrying money and making change which includes a signaling device for emitting a signal each time the apparatus is opened. The apparatus also includes a counter which counts and records the number of times the apparatus is opened.

3 Claims, 2 Drawing Sheets

FIG. 3
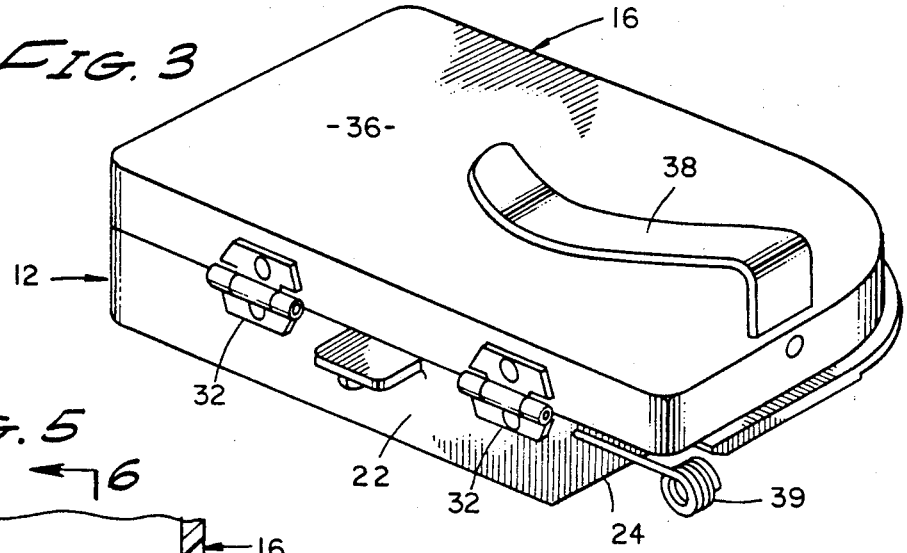
FIG. 5
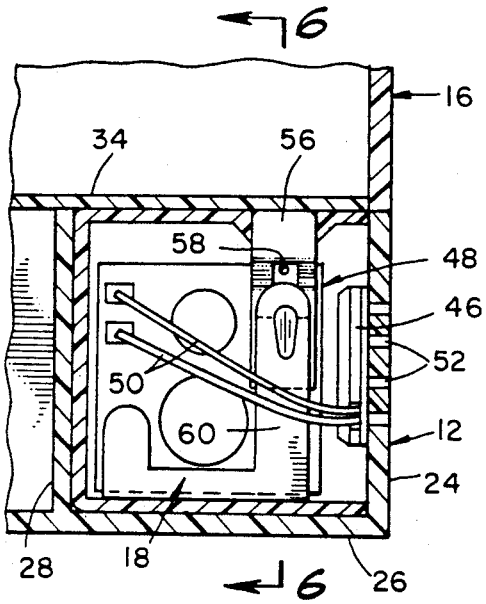
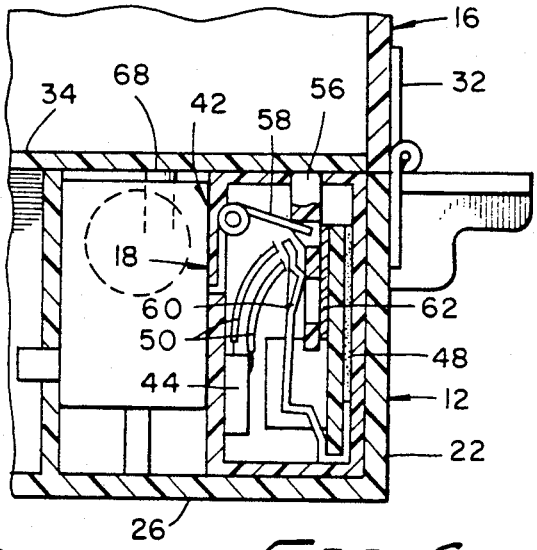
FIG. 6
FIG. 7
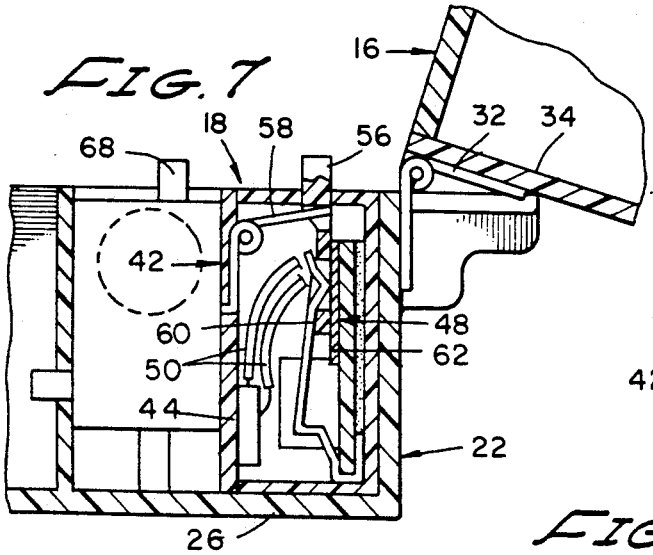
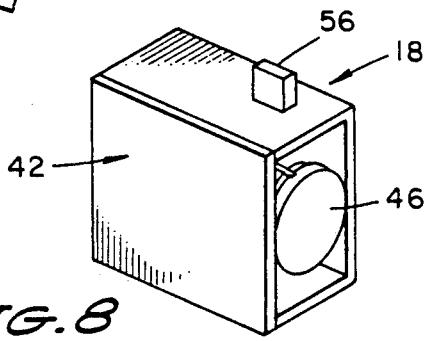
FIG. 8

CASH CADDY

BACKGROUND OF THE INVENTION

1. Field of The Invention

The present invention relates generally to an apparatus for making change. More particularly, the invention concerns a change making apparatus of the character typically carried by cocktail waitresses for making change after serving a customer in a bar or dining area. The apparatus includes a built-in signaling device adapted to emit a detectable signal each time the apparatus is opened.

2. Discussion of The Invention

Waitresses, such as cocktail waitresses, typically serve a customer at a table and are paid by the customer at the time of service. Accordingly, the waitress must be able to make change at the time of payment. To expedite the change making process, several different types of portable, change making devices have been developed. Generally, such devices include a small container having an openable lid and a body portion provided with coin receiving channels for carrying coins of various denominations. When the waitress is paid by the customer, the lid is opened, the money received from the customer is placed within the device and appropriate change is selected from the coins within the coin receiving channels and given to the customer.

When the waitress is not serving a customer, the change making device may be left unattended for short intervals of time. During these periods unauthorized removal of money from the device can occur. One purpose of the present invention is to discourage such unauthorized removal of money by including within the device a signaling means for emitting a signal each time the lid of the device is opened. The signal emitted may be in the nature of a radio signal which can be detected so as to enable location of the device or it may be an audio or visual signal. If the signaling means emits an audio signal, such as a tune, the apparatus can also take on the character of a novelty, or advertising device.

In one form of the apparatus of the invention, a counting means is provided for counting and recording the number of times the lid of the device is opened. This feature of the device permits the waitress to keep track of the times the lid is opened and thereby record change making activity and detect any unauthorized opening of the device during a time when it is left unattended. When an audio or visual signal is undesirable, the counting means can be used for detecting unauthorized opening of the device.

SUMMARY OF THE INVENTION

It is an object of the present invention to provide a portable apparatus for carrying money and for making change in which there is included a signaling device that emits a detectable signal each time the device is opened.

It is another object of the invention to provide an apparatus of the character described in the preceding paragraph in which each time the device is opened the signaling device emits an audio signal in the form of a short tune. The tune can be one associated with the establishment in which the device is being used, can be associated with a product being served, such as a given beer or wine, or the tune can be selected mainly for the amusement of the customer.

Another object of the invention is to provide a change making apparatus of the class described which is of simple design and one which can be very inexpensively manufactured.

BRIEF DESCRIPTION OF THE DRAWINGS

FIG. 3 is a generally perspective view of the device similar to FIG. 1, but illustrating the appearance of the device when viewed from the rear.

FIG. 5 is a cross sectional view taken along lines 5-5 of FIG. 4.

FIG. 6 is a cross sectional view taken along lines 6-6 of FIG. 5.

FIG. 7 is a fragmentary cross sectional view similar to FIG. 6, but showing the lid of the device in an open position to activate the counting and signaling mechanisms of the device.

FIG. 8 is a generally perspective view of the signaling and counting mechanism of the apparatus of the invention.

DESCRIPTION OF THE DRAWINGS

Figure 1:
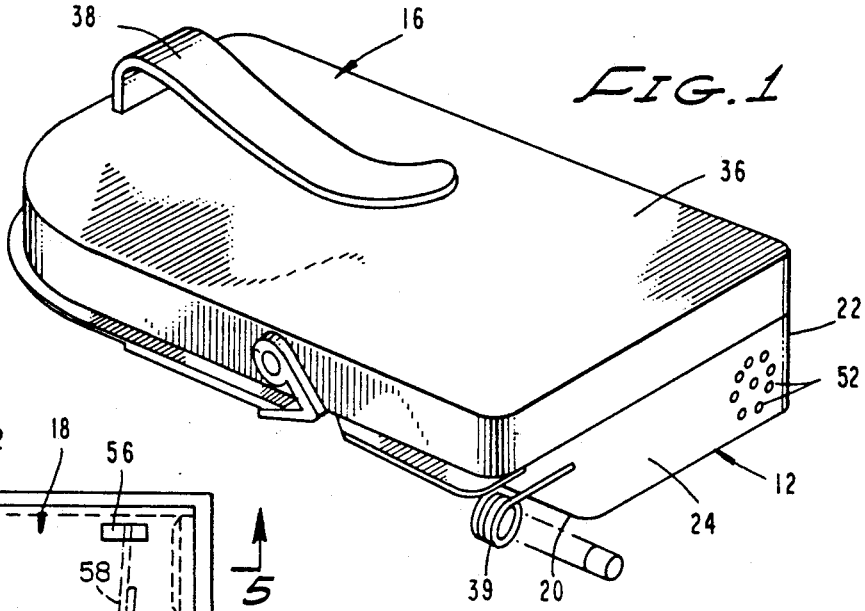
FIG. 1 is a generally perspective view of the cash carrying device of the present invention.
Figure 2:
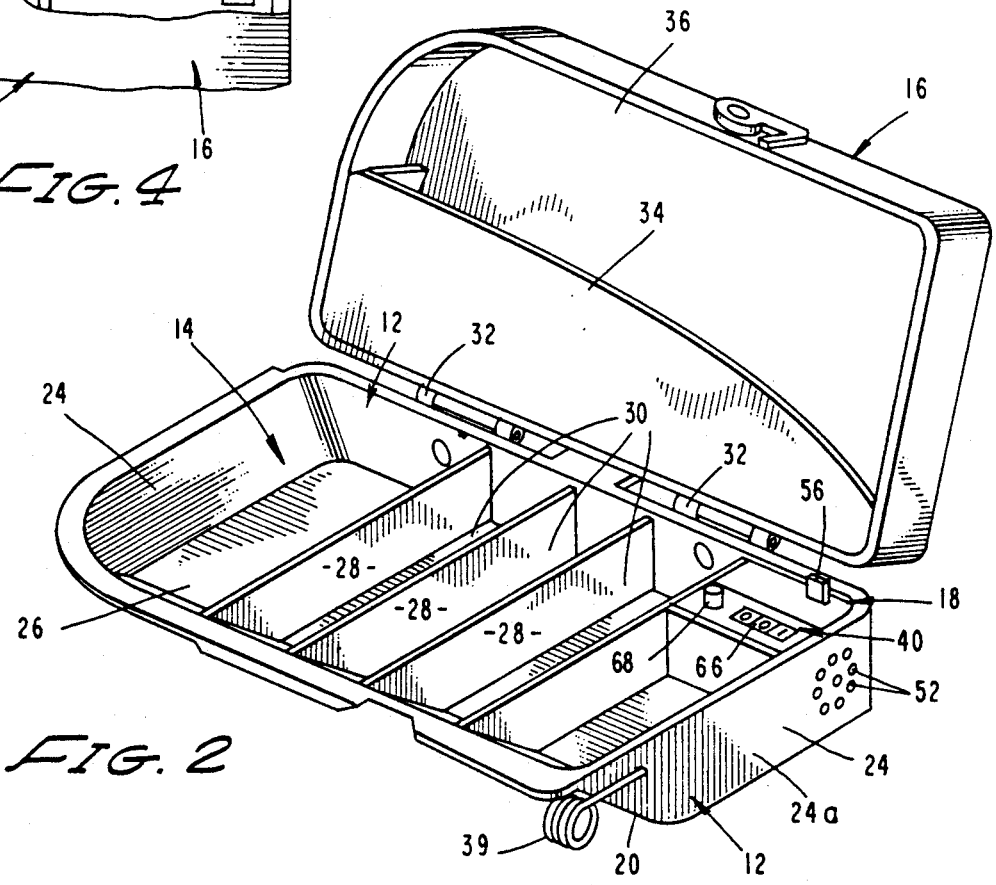
FIG. 2 is a generally perspective view of the device, but showing the cover in an open position.

Referring to the drawings, and particularly to FIGS. 1, 2 and 3, the cash carrying apparatus of the present invention comprises a body portion 12, having a change receiving cavity 14 therewithin; a top closure member 16 hingably connected to body portion 12; and signal mean carried internally of body portion 12 for emitting a signal upon opening of the top closure member 16. The signal means is generally designated by the numeral 18. As best seen by referring to FIG. 2, body portion 12 includes interconnected front, back, side and bottom walls 20, 22, 24 and 26, respectively. Extending between front and back walls 20 and 22 are a plurality of transversely spaced partitions 28. Partitions 28 are transversely spaced so as to define a plurality of coin receiving channels 30 of different widths so as to receive coins of various denominations.

Top closure member 16 is hingably connected to the back wall 22 of body portion 12 by means of suitable hinges 32. As can be seen by referring to FIGS. 1 and 2, top closure member 16 is movable from a first closed position as shown in FIG. 2, wherein it is in engagement with the front and side walls of the body portion, to a second opened position shown in FIG. 2, wherein it is spaced apart from the front and side walls of the body portion. Extending longitudinally of top closure member 16 is a curved planar wall 34 which cooperates with top wall 36 of the top closure member to define a compartment adapted to receive paper currency. In a manner presently to be described, when top closure member 16 is moved to its second, open position, the signaling means is actuated. provided on the top wall of top closure portion 16 is a spring clip 38 for holding napkins and the like. A coiled spring 39 is provided on the housing to removably attach the device to a tray.

Another important feature of the apparatus of the present invention is counter means, generally designated by the numeral 40, which is housed within body portion 12, and functions to record each instance of movement of the top closure means 16 from the first closed position to the second open position. The construction and operation of this counter means will presently be described.

Turning to FIGS. 5, 6 and 7, the signal means of the instant form of the invention comprises a housing 42 within which is mounted circuit means including an integrated circuit 44 interconnected with a source of electricity, such as a battery (not shown), a piezoelectric crystal 46, switching means 48 for selectively energizing the piezoelectric crystal and electrical conductors 50 for electrically interconnecting the various operating elements of the signal means. The integrated circuit is of a standard design well understood by those skilled in the art and functions to cause resonation of the piezoelectric crystal in a manner to produce the desired sounds. The integrated circuit design forms no part of the present invention and the details thereof will not be described. Crystal 46 is located proximate the side wall designated in FIG. 2 by the numeral 24a. Side wall 24a is provided with a plurality of small apertures 52 so that the sounds produced by the crystal can clearly be heard.

The switching means 48 of the present embodiment of the invention includes an actuating arm 56 which is normally urged outwardly of housing 42 in the manner shown in FIG. 7 by a biasing means, hereshown as a torsion spring 58 which is mounted within housing 42. When top closure member 16 is in its first closed position as shown in FIG. 6, arm 56 is pushed downwardly against the urging of spring 58. When arm 56 is in this downward position the yieldably deformable, spring contact arm 60 of the switching mechanism is moved by arm 56 out of contact with contact plate 62 of the switching mechanism. However, when top closure member 16 is opened as shown in FIG. 6, spring 60 urges arm 56 upwardly permitting the contact arm due to its inherent resilience to move into contact with plate 62 thereby closing the circuit and energizing crystal 46. If the crystal and integrated circuit are designed so that a tune is produced by the crystal, the tune will commence each time top closure member 16 is opened.

It is to be understood that the signal means can readily be designed by those skilled in the art so that any type of desired audio, visual or electronic signal can be generated upon opening of the device.

Figure 4:
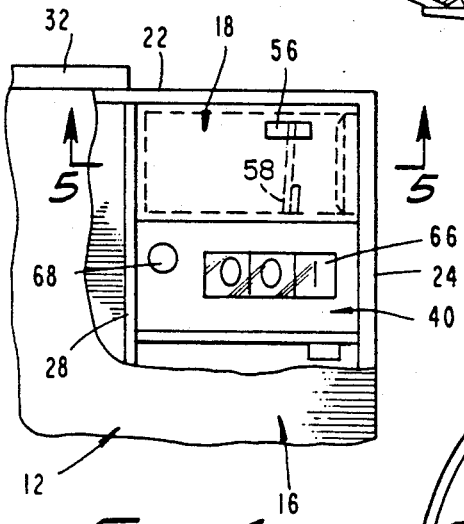
FIG. 4 is a fragmentary view of one corner of the apparatus of the invention partly broken away to show the appearance of the counting and signaling means of the device.

Also provided in the embodiment of the invention shown in the drawings is a counter means shown here as a digital counter 40, which includes a digital display 66, and actuating means comprising an upstanding operating arm 68 (FIGS. 4 and 7), which is engaged by panel 34 when top closure member 16 is in the first, closed position (see FIG. 6). Digital counter 40 is of a standard design and is readily commercially available. While the counter means can be of various designs it is constructed so that each time top closure member 16 is opened, operating arm 68 will be moved upwardly by a suitable biasing means (not shown) and through a suitable internal mechanism will advance the digital display one number. In this way the number of times that the device is opened can automatically be recorded.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A change making apparatus comprising:

(a) a body portion having interconnected front, back, side and bottom walls;

(b) a plurality of transversely spaced partitions extending between said front and back walls, and defining a plurality of coin receiving channels;

(c) a top closure member hingably connected to said body portion, said top closure member being movable from a first closed position in engagement with said front side walls to a second open position spaced apart from said front and side walls;

(d) signal means carried by said body portion for emitting a signal upon movement of said top closure member toward said second open position; and (e)) counter means carried by said body portion for counting and recording each instance of movement of said top closure means from said first position to said second position.

2. A change making apparatus as defined in claim 1 in which said counter means comprises a digital counter having a digital display and actuating means operably associated with said top closure member for actuating said digital display upon movement of said top closure member from said first position to said second position.

3. A change making apparatus comprising:

(a) a body portion having interconnected front, back, side and bottom walls;

(b) a plurality of transversely spaced partitions extending between said front and back walls defining a plurality of coin receiving channels;

(c) a top closure member hingably connected to said back wall of said body portion, said top closure member being movable from a first closed position in engagement with said front and side walls to a second open position spaced apart from said front and side walls;

(d) signal means connected to said body portion for emitting an audio signal upon movement of said top closure member from said first to said second position, said signal means comprising a piezoelectric crystal and means for energizing said crystal to produce sound; and (e) counter means for counting and recording movement of said top closure member between said first and second positions, said counter means comprising a digital counter having a digital display and actuating means operably associated with said top closure means for actuating said digital display upon movement of said top closure member between said first and second positions.

* * * * *